US005361836A

United States Patent [19]

Sorem et al.

[11] Patent Number: 5,361,836

[45] Date of Patent: Nov. 8, 1994

[54] STRADDLE INFLATABLE PACKER SYSTEM

[75] Inventors: Robert M. Sorem, Sugar Land, Tex.; David M. Eslinger, Broken Arrow, Okla.; Bart V. Thomeer, Houston, Tex.

[73] Assignee: Dowell Schlumberger Incorporated, Sugar Land, Tex.

[21] Appl. No.: 128,379

[22] Filed: Sep. 28, 1993

[51] Int. Cl.[5] ..... E21B 33/00

[52] U.S. Cl. ..... 166/187

[58] Field of Search ..... 166/187, 191, 179, 118, 166/120, 126, 131, 387

[56] References Cited

U.S. PATENT DOCUMENTS 5,205,567 4/1993 Quinlan et al. ..... 166/187 X 5,280,824 1/1994 Eslinger et al. ..... 166/187

*Primary Examiner*—Thuy M. Bui

*Attorney, Agent, or Firm*—Stephen A. Littlefield

[57] ABSTRACT

A straddle inflatable packer system includes upper and lower packer assemblies each having an inner elastomer sleeve surrounded by expansible armor members. For well treating operations, the upper packer includes an external elastomer sleeve which covers a lower portion of its armor members, and the lower packer has an external elastomer sleeve that covers an upper portion of its armor members, so that the external sleeves are located adjacent to the higher pressures of injected fluids. For well testing operations, the locations of the external packer sleeves are reversed so that again these sleeves are adjacent the higher well bore pressures during the test.

5 Claims, 1 Drawing Sheet

FIG. 1
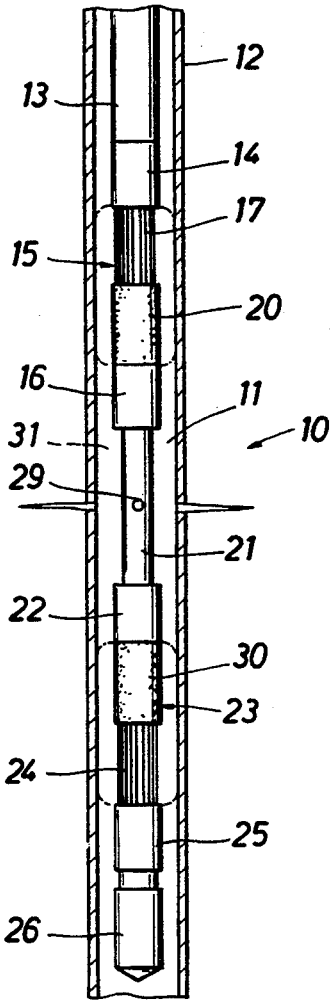
FIG. 2
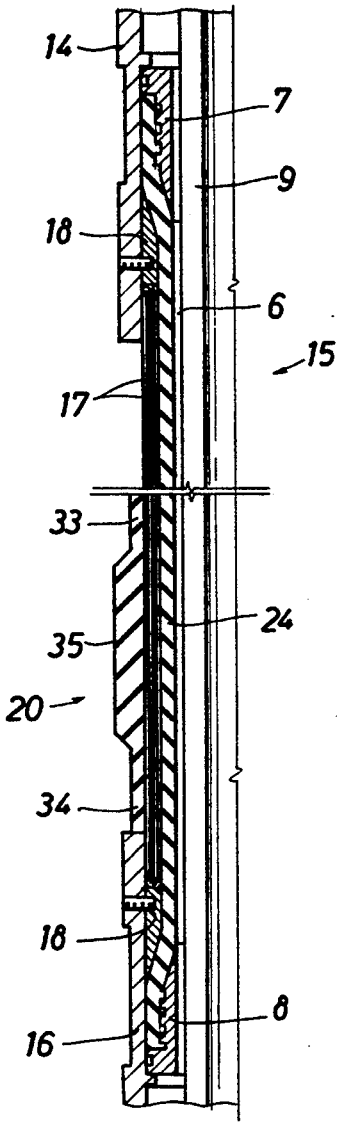
FIG. 4
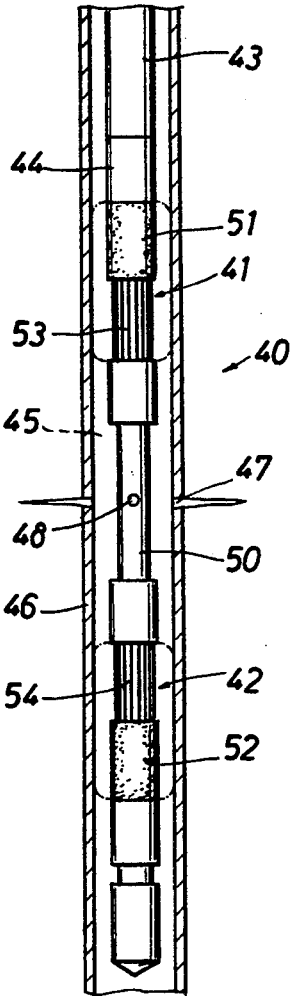
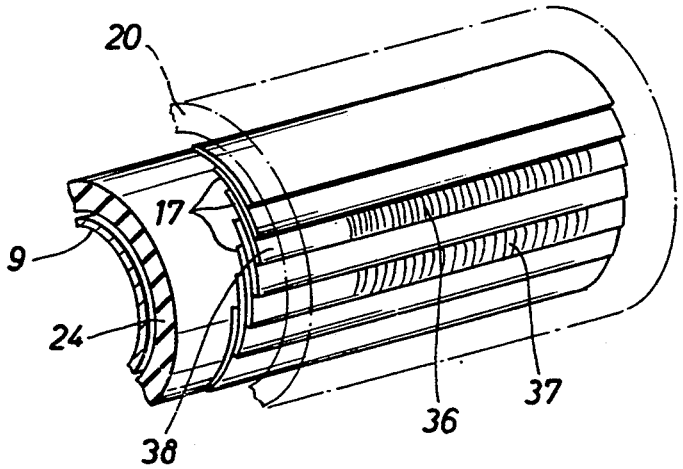
FIG. 3

STRADDLE INFLATABLE PACKER SYSTEM

FIELD OF THE INVENTION

This invention relates generally to an inflatable packer system where upper and lower packers are expanded by internal fluid pressure into sealing contact with surrounding well bore walls to isolate a zone of the well, and particularly to a new and improved straddle-type inflatable packer system where outer elastomer covers are positioned in such a way as to enhance the zone isolation.

BACKGROUND OF THE INVENTION

Inflatable packers have been used extensively in various well testing, treating and workover operations for many years. A typical inflatable packer has an elastomer sleeve that is mounted by end rings on a tubular body which is lowered into an open or cased well bore on a running string of jointed tubing, coiled tubing or wireline. When the packer is at the desired depth in the well, fluid pressure is applied to the interior of the sleeve via ports in the body to cause the sleeve to be expanded outward into sealing engagement with the well wall. Where an interval of the well is to be tested or treated which is off bottom, a so-called "straddle" packer arrangement is employed where two inflatable packers are run in tandem so that one bridges the well bore above the interval and the other one below same.

Since an inflatable packer is subjected to expansion forces as well as abrasion or cutting threes which can cause severe damage and possible malfunction thereof downhole, it has become common practice to armor the outside of the elastomer sleeve in various ways. One way is to use a plurality of longitudinally extending, overlapping slats that slide transversely relative to one another as the inner elastomer sleeve expands. Other structures include reverse-layed cables and woven composite cables or wires. All such constructions provide a protection for the sleeve against abrasion and cuts. Although the overlapping slats, cables or composite armor structures protect the elastomer sleeve or bladder of the inflatable packer, of their nature they are incapable of providing a seal against a well bore wall because of the external longitudinal passages formed by the manner in which they are arranged. Thus it is necessary to surround at least some portions of the armor members by an outer elastomer cover which provides sealing engagement with the well wall upon expansion of the inner elastomer sleeve. Such outer cover can be bonded to at least some of the armor members, or to portions thereof.

Although known straddle packer systems have had elastomer outer covers, such covers have been arranged in one of the following ways: (1) the entire lengths of each packer is completely covered; (2) centrally located covers with armor members exposed on either side thereof; (3) upper and lower covers on each packer with armor members exposed in the center regions thereof; (4) an upper elastomer cover on each packer with armor members exposed therebelow. However, after these packer systems are inflated, and during injection of fluid in the annular region between the set packers, the length of exposed armor members which are subjected to the pressure of injection fluids does not tend to anchor the packer because the walls of the packer from the diameter of the body having injection ports out to the cover/bore wall seal line tends to be pressure balanced. Thus the available length of the packer is not efficiently used.

An object of the present invention is to provide a new and improved straddle inflatable packer system which is more efficiently arranged.

Another object of the present invention is to provide a new and improved straddle inflatable packer system arranged such that substantially the full length on each packer tends to anchor in a well bore.

Still another object of the present invention is to provide a new and improved straddle inflatable packer arrangement having external elastomer covers positioned with respect to the isolated zone so that fluid leakage past the packers is minimized.

SUMMARY OF THE INVENTION

These and other objects are attained in accordance with the concepts of the present invention through the provision of an a straddle inflatable packer system for isolating a well bore zone and including a tubular body carrying longitudinally spaced, upper and lower inflatable packer assemblies and providing an inflation passage leading to the inside of each assembly so fluid pressure can be applied to expand them outward into sealing contact with the surrounding well bore wall. Each packer assembly includes an inner elastomer sleeve or bladder having armor covering the outside thereof in the front of overlapped slats or cables whose upper and lower ends are attached to retainer rings on the body. A first elastomer seal sleeve covers the upper portion of the armor on the lower assembly, and a second elastomer seal sleeve covers the lower portion of the armor on the upper assembly. Thus when the packer assemblies are expanded by fluid under pressure, the respective cover sleeves are bulged outward and engage the well bore wall and provide sealing actions which are closely adjacent the ends of the isolated zone. Thus there are no sections of the armor that tare pressure balanced since such sections are located away from the isolated zone. Moreover fluid leakage past the packer elements is minimized since the exposed portions of the armor are separated from the ends of the isolated zone by the outer elastomer covers. Where the packer system is to be used for a drill stress test where pressure in the isolated zone are reduced well below the pressure in the well bore above and below the packers, the cover on the upper packer is located near the upper end of the packer assembly, where the cover sleeve for the lower packer assembly is located adjacent its lower end. Thus in each case the cover sleeves provide seals where high pressure differential are created when the straddle packer assembly is used to minimize the possibility of fluid leakage and to minimize straddle packer length.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 1 is a longitudinal elevational view of a straddle inflatable packer assembly in a well bore and used in a well treating operation;

FIG. 2 is an enlarged quarter sectional view of the upper inflatable packer in accordance with the present invention;

FIG. 3 is a fragmentary isometric view of a portion of the packer shown in FIG. 2; and FIG. 4 is a view similar to FIG. 1 but showing a straddle packer system used in connection with a drill stem test.

DETAILED DESCRIPTION OF A PREFERRED EMBODIMENT

Referring initially to FIG. 1, an inflatable straddle packer assembly indicated generally at 10 is shown suspended in a well bore 11 which may be lined with casing 12 or may be uncased (open hole). The assembly 10 is suspended on a running string 13 of wireline, jointed tubing, or on continuous coiled tubing that has been unwound from a reel at the surface and injected into the well bore 11. The lower end of the string 13 is connected to a mandrel 9 (FIG. 2) which carries a retainer collar 14 that forms the upper end of the upper packer element 15. Another retainer collar 16 forms the lower end thereof. An armoring means such as a plurality of circumferentially spaced, overlapping metal slats 17 extend between the collars 14 and 16, with the opposite ends of the slats being secured to anchor rings 18 by welding. Although overlapped slats are shown, other structures such as reverse-layed cables and woven or composite cables or wires also could be used. An internal elastomer sleeve 24 extends between upper and lower annular members 7 and 8 which seal and secure the ends of the sleeve to collars 14, 16. An external elastomer sleeve 20 covers approximately the lower half of the length of the armor 17 of the upper packer element 15, so that the upper half of such armor remain exposed as shown.

As shown in FIG. 1, a spacer nipple 21 is connected between the lower end of the upper packer assembly 15 and the upper end of the lower packer assembly 23. The assembly 23 is essentially an inverted, mirror image of the upper packer assembly 15 and also has an armor means 24 which extends from an anchor ring that is inside the upper retainer collar 22 down to an anchor ring that is inside the lower retainer or collar 25. The lower end of the assembly 10 may be closed by a plug 26. Hereagain the upper and lower ends of the armor means 24 are secured by welding to anchor rings like those shown in FIG. 2 as elements 18, and an external elastomer sleeve 30 covers approximately the upper half of the length of the armor areas 24. The lower packer assembly 23 also includes an inner elastomer sleeve like the element 24 in FIG. 2, whose ends are received in the same manner. The spacer nipple 21 has injection ports 29 which communicate with the well interval 31 between the packer assemblies 15 and 23. Thus it will be apparent that when the packer assemblies 15 and 23 are expanded as shown in phantom lines in FIG. 1, the external elastomer sleeves 20 and 30 pack off the respective upper and lower ends of the isolated zone 31, and are located on the ends of the packers which are adjacent the injection ports 29, whereas the exposed lengths of the armor means 17 and 24 are located remote from such zone.

FIG. 2 shows further details of the upper packer assembly 15, it being recognized that the lower packer 23 is made the same way but is inverted. The packer assembly 15 includes an inner elastomer sleeve or bladder 24 which surrounds the mandrel 9 and whose opposite ends are connected in a leak-proof manner to the retainer collars 14 and 16 by inner rings 7 and 8. Fluid pressure applied to the inner surfaces of the sleeve 24 via the annular space 6 causes it to balloon outward and thus force the slats or other armor means 17 outward. During such outward movement the slats 17 slide laterally over one another as their overall diameter is gradually increased, however their widths are sufficient that no holidays are formed through which the bladder 24 can extrude. In one embodiment the external cover sleeve 20 can include upper and lower thin sections 33, 34 and a central thickened section 35, or in another embodiment the packer sleeve 20 can have a uniform thickness throughout its length. On the other hand a thin section could be used at only one end of the thickened section 35. The upper and lower end surfaces of the thick section 35 preferably are inclined as shown so that no abrupt shoulders are formed which might hang up in the well during running or retrieving.

FIG. 3 shows-further details of the construction of the packer assemblies 15 and 23. The inner elastomer sleeve 24 surrounds the mandrel or body 9 and in turn is surrounded by the metal straps 17 which are substantially overlapped to give a wide range of expansion. The outer elastomer cover 20 surrounds a portion of the straps 17, and can be bonded to at least some of the exposed external surfaces thereof as shown by the hatches areas 36, 37. Other bonding patterns also can be used. As noted above, other armoring means can be used such as reverse-layed cables or woven composite cables or wires.

FIG. 4 shows a straddle inflatable packer system 40 which is adapted for use in a drill stem testing operation where upper and lower packer assemblies 41 and 42 are inflated and expanded into sealing contact with the well bore walls by inflation pressure that is applied by any suitable means. The running string 43 initially is either empty of fluids, or has a column or cushion of water in the lower part thereof, and a tester valve 44 initially is closed so that a pressure region exists in the running string 43. After the packers 42 and 42' are expanded as shown in phantom lines to pack off and isolate an interval 45 therebetween, the valve 44 is opened to reduce the pressure in the interval 45 and induce any fluids in the formation outside the casing 46 to flow into the running string 43 via the perforations 47 and the ports 48 in the spacer nipple 50. After a short flow period of time, the test valve 44 is closed to enable pressures in the interval 34 to build up. A suitable pressure recorder (not shown) provides a record of pressure changes vs. time, from which various useful formation characteristics can be determined.

In the embodiment shown in FIG. 4, the upper and lower elastomer cover sleeves 51, 52 are mounted adjacent to where the higher pressures exist during the drill stem testing operation, whereas the exposed lengths of the armor means 53, 54 are located on the lower pressure sides of the packer assemblies 41, 42. Since the fluid pressure seal or pack-off is provided by the cover sleeves 51, 52, the exposed lengths of the armor means 53, 54 do not tend to be pressure balanced so that the straddle packer lengths can be minimized. Moreover there is no teaching for fluid leakage past the exposed armor sections 53, 54 because the cover sleeves 51, 52 close off all leakage paths along the armor means underneath the sleeves.

OPERATION

In operation, the straddle packer assembly 10 is assembled as shown in the drawings and is lowered into the well bore 11 on the running string 13 until the inflatable packer assemblies 15 and 23 are located respectively above and below the zone 31 to be isolated. Fluid pressure then is applied to the running string 13 at the surface and acts through the annular space 6 on the inner walls of the inner elastomer sleeves 24. The pressure differentials that are developed across the walls of the sleeves 24 expand therein, the armor means 17 and the external cover sleeves 20 and 30 into sealing contact with the surrounding well bore walls. The exposed lengths of the armor means 17 and 24 also engage the wall and provide friction anchors against longitudinal movement. The outward pressure exerted by the expanded inner sleeves 24 cause inner regions of the external cover sleeves 20 and 30 to extrude any longitudinal channels (such as at 38 FIG. 3, for example) formed at the edges of overlapped slats 17, where such slats are used, so that a complete packoff is obtained. To retract the packer elements 15 and 23 the applied fluid pressure is released, so that the inherent resilience of the bladders 24, the external cover sleeves 24 and 30 and the slats 17 or armor means returns them to their retracted conditions as shown in FIG. 2. Then the packer assemblies can be removed from the well, or moved to another location where other service work can be performed. Since the elastomer sleeves 20 and 30 are positioned adjacent the respective upper and lower ends of the zone 31 where high pressure exists during a treating operation, and thus seal off such high pressure from the well regions above and below the isolated zone, the exposed lengths of the armor means 17 and 24 are not subject to balanced pressures, and thus tend to anchor in the casing. The available packer length is more efficiently used, as opposed to prior arrangements. The same benefits are obtained in the drill stem testing embodiment shown in FIG. 4 where the external elastomer sleeves 51, 52 are located adjacent the higher pressure regions of the well bore during the test, and the exposed armor means are located remote from such higher pressures. Hereagain the available length of each inflatable packer is more efficiently used to seal off the end of the isolated zone 45 (while providing more effective anchoring forces by the exposed lengths of the armor means 53, 54).

It now will be recognized that a new and improved straddle inflatable packer system has been disclosed. The exposed slat areas of each packer element are not subjected to pressure balanced conditions so that the full length of each packer element anchors in the well bore, and the external elastomer covers are arranged to provide sealing actions adjacent the regions of higher pressures which minimizes fluid leakage. Since certain changes or modifications may be made in the disclosed embodiment without departing from the inventive concepts involved, it is the aim of the appended claims to cover all such changes and modifications falling within the true spirit and scope of the present invention.

What is claimed is:

1. An inflatable packer system adapted to straddle and pack-off a zone in a well bore, said system comprising: a tubular body; upper and lower inflatable packer assemblies mounted on said body, each of said packer assemblies including an internal elastomer sleeve and expansible armor means covering said sleeve; said upper packer assembly having an external elastomer sleeve covering a lower portion of the armor means therein with an upper portion of said armor means being exposed, and said lower packer assembly having an external elastomer sleeve covering an upper portion of the armor means thereon with lower portions of said armor means being exposed.

2. The inflatable packer system of claim 1 wherein each of said external elastomer sleeves has a increased diameter portion and a reduced diameter portion adjacent said increased diameter portion.

3. The inflatable packer system of claim I wherein said armor means comprises circumferentially spaced, overlapped metal slats.

4. An upper inflatable packer element for use in a straddle packer system, comprising: a tubular body; upper and lower retainer collars on said body, an inner elastomer sleeve member on said body and having its opposite ends attached thereto; a plurality of circumferentially spaced, overlapping metal slats covering said inner sleeve and extending between said retainer collars and attached thereto; and an external elastomer sleeve covering a lower portion of said slats but leaving an upper portion thereof exposed, so that fluid pressure applied to the interior of said inner elastomer sleeve expands it, said slats and said external sleeve outward to cause said external sleeve to sealingly engage a well bore wall adjacent said lower retainer collar.

5. A lower inflatable packer element for use in a straddle packer system, comprising: a tubular body; upper and lower retainer collars on said body; an inner elastomer sleeve member on said body and having its opposite ends attached thereto; a plurality of circumferentially spaced, overlapping metal slats covering said inner sleeve and extending between said retainer collars and attached thereto; and an external elastomer sleeve covering an upper portion of said slats but leaving a lower portion thereof exposed, so that fluid pressure applied to the interior of said inner elastomer sleeve expands it, said slats and said external sleeve outward to cause said external sleeve to sealingly engage a well bore wall adjacent said upper retainer collar.

* * * * *